US006202220B1

(12) United States Patent
Rhoden

(10) Patent No.: US 6,202,220 B1
(45) Date of Patent: Mar. 20, 2001

(54) DROP CROTCH PANTS

(76) Inventor: Ricknal J. Rhoden, 4509-B McChord Dr. SW., Lakewood, WA (US) 98499

( * ) Notice: Subject to any disclaimer, the term of this patent is extended or adjusted under 35 U.S.C. 154(b) by 0 days.

(21) Appl. No.: 09/288,895

(22) Filed: Apr. 9, 1999

(51) Int. Cl.[7] ..... A41D 1/06
(52) U.S. Cl. ..... 2/236; 2/227; 2/220
(58) Field of Search ..... 2/227, 228, 238, 2/236, 237, 220, 221

(56) References Cited

U.S. PATENT DOCUMENTS

| | | | | |
|---|---|---|---|---|
| D. 140,465 | * | 2/1945 | Kotzin | 2/221 |
| D. 262,325 | | 12/1981 | Miller et al. . | |
| 3,435,462 | | 4/1969 | Bank . | |
| 4,188,672 | * | 2/1980 | Kalso | 2/221 |
| 4,282,608 | | 8/1981 | Amberg . | |
| 4,561,121 | | 12/1985 | Ehring et al. . | |
| 4,989,272 | | 2/1991 | Wagner . | |
| 5,010,595 | | 4/1991 | Stradley . | |
| 5,033,126 | | 7/1991 | Wruck et al. . | |
| 5,050,244 | * | 9/1991 | Kleinman | 2/227 |
| 5,068,920 | | 12/1991 | Bray . | |
| 5,168,582 | | 12/1992 | Aldridge . | |
| 5,219,367 | | 6/1993 | Fields . | |
| 5,289,590 | | 3/1994 | Larson . | |
| 5,689,832 | | 11/1997 | Head . | |

* cited by examiner

*Primary Examiner*—Bibhu Mohanty
(74) *Attorney, Agent, or Firm*—Black Lowe & Graham PLLC

(57) ABSTRACT

A pair of pants having two waistbands: one true waistband for securing the pants about a wearer's waist, and a second false waistband for creating the appearance that the pants are being worn at or below the level of the wearer's hips.

7 Claims, 3 Drawing Sheets

DROP CROTCH PANTS

FIELD OF THE INVENTION

The present invention relates generally to the field of garments, generally referred to as pants, trousers, jeans or dungarees, and, more particularly, to pants which have the appearance of a sagging waistline.

BACKGROUND OF THE INVENTION

Garments such as pants, trousers, jeans or dungarees, which will be referred to collectively as pants, are constructed so as to cover and conform, more or less, to the shape of the human body. In recent times, it has become fashionable among the younger segment of the population to wear pants with the waistband at or below the level of the hips, and sometimes below the level of the buttocks. Typically, this was accomplished using pants which were several sizes larger than conventionally needed, and fastening a belt snugly about the body at the level desired. In many cases, the wearer of the pants intentionally leaves boxer shorts or other undergarments exposed. In other cases, the wearer seeks the baggy look but wants to avoid undergarment exposure. But, due to the excessively large waistband, pants worn in this manner would sometimes inadvertently fall, exposing undergarments or certain portions of the human anatomy not meant to be exposed, for instance, the anal cleft. Worse, such a slippage of the pants could trip the wearer, thereby resulting in subsequent injury to the wearer.

Some have addressed these problems by attaching a fake sagging double bottom on to a pair of conventional trousers. For example, Head, U.S. Pat. No. 5,689,832, teaches adding a separate layer of fabric overlaying the rear surface of the pants. The added layer includes an auxiliary waistband extending along the seat of the pants to lend the appearance of a sagging pair of pants.

The sagging double bottom pants taught by Head address some of the problems associated with the wear of large-waisted sagging pants, but introduces new shortcomings of its own. For example, the Head approach adds bulk by incorporating an additional fabric layer. When the fabric is denim, as would commonly be the case, the added weight would be substantial. Further, Head teaches a secondary belt that extends only across the seat and, indeed, is incapable of continuing across the front of the pants because of the added panel approach. In addition, because Head begins with a conventional pair of pants, the sagging double bottom pants include an awkward half-pocket arrangement above the secondary beltline.

The present invention is a novel approach to saggy pants that addresses the problems of the prior art.

SUMMARY OF THE INVENTION

The present invention creates the impression of pants worn below the waist by providing a false waistband, along with traditional pant structures, such as pockets, flies, and crotches at levels lower than normal, as well as a true waistband for properly securing the pants at the waist level.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
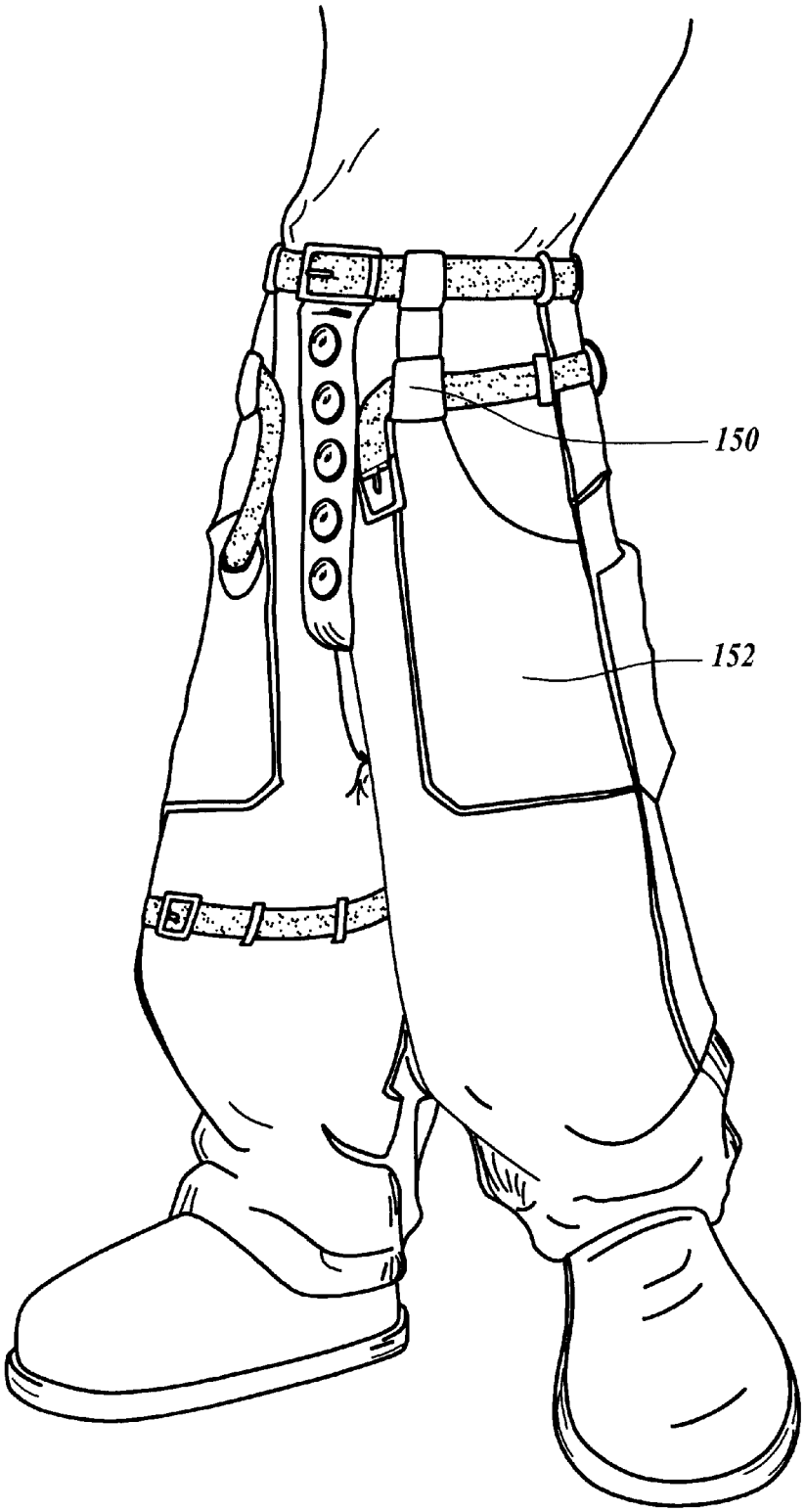
FIG. 1 is a front perspective view of pants according to a present embodiment of the invention.
Figure 2:
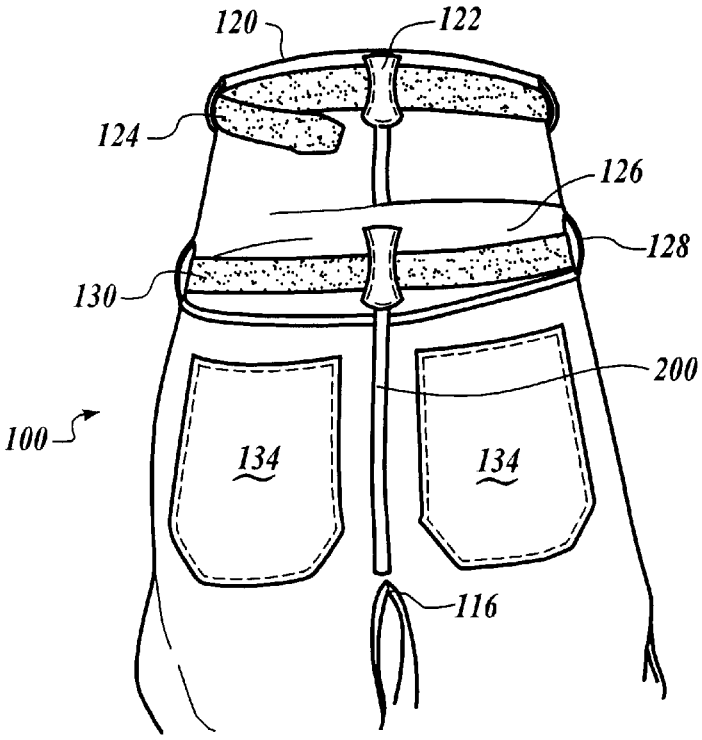
FIG. 2 is a rear view of pants according to the present invention.
Figure 3:
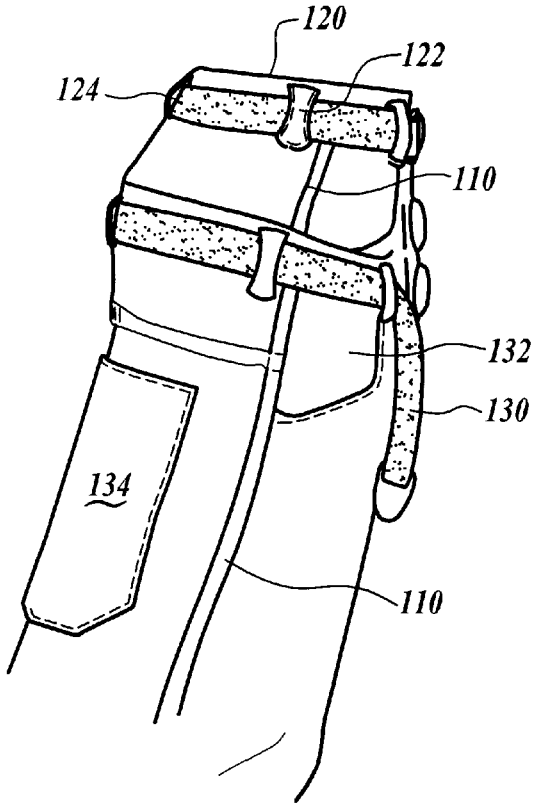
FIG. 3 is a side view of pants according to the present invention.

Referring to FIGS. 1–3, the pants 100 according to the present invention, are constructed in a conventional manner from four panels: left and right front panels 102 and 104, and left and right rear panels 106 and 108. Those skilled in the art will recognized that the pants 100 may alternatively be constructed from two sections, such as a front and back section, or a left and right section, where each section is fashioned from a single sheet of material, without departing from the spirit of the invention. Likewise, any material may be used, including, for example, denim, corduroy, khaki, or other fabrics.

The left front panel 102 and left rear panel 106 are joined together at a side seam 110 as well as an inseam 112. The side seam 110 runs along the entire length of the left front panel 102 and left rear panel 106, from the bottoms of the panels at a cuff 114, up to a true waistband 120. The side seam 110 is formed by joining the edges of the left front panel 102 and left rear panel 106 corresponding to the outside of the wearer's leg in any conventional manner such as sewing or riveting.

The left front panel 102 and left rear panel 106 are further joined together along an inseam 112 running from the cuff 114 up to the level of a crotch 116. The joined left front panel 102 and left rear panel 106 form a left section of pants 100.

A right section of pants 100 is formed by a right front panel 104 and right rear panel 108 joined together in a manner substantially the same as for joining the left front panel 102 to the left rear panel 106. The inseam 112 of the of the left section is joined to the inseam 112 of the right section at the crotch 116. The left section of pants 100 is essentially a mirror image of the right section of pants 100 except that the left section also includes a fly cover 118. Those skilled in the art will recognize that this configuration is traditionally associated with pants for males, whereas pants for females typically include the fly cover 118 as part of the right section of pants 100, but will readily appreciate that either configuration may be used for either gender of wearer.

The left section of pants is joined to the right section of pants beginning at the crotch 116. In the front, the left front panel 102 is joined to the right front panel 104 from the crotch 116 up to the level of the fly cover 118. Under the fly cover 118, the left and right front panels 102 and 104, respectively, are provided with mating fasteners (not shown) to releasably close an opening between the true waistband 120 and the bottom of the fly cover 118. As is well-known in the art, the mating fasteners may be one or more of a zipper, buttons and buttonholes, hooks and eyes, male and female halves of hook and loop fasteners and the like. Likewise, the fly cover may include buttons or other attachments that serve an ornamental purpose.

In the rear, the left rear panel 106 is joined to the right rear panel 108 from the level of the crotch 116 up to the level of the true waistband 120 at a rear seam 200.

According to the present invention, a true waistband 120 of pants 100 provided to secure pants 100 about of the waist of a wearer. The true waistband 120 is typically fitted with a number of true belt loops 122 for use with a true belt 124 to secure the pants 100 about the wearer's waist. The pants 100, however, need not include a true belt 124 or belt loops 122, consistent with the present invention.

Additionally, a false waistband 126 is formed about the pants 100 at a level below the true waistband 120. The false waistband 126 is defined by a series of false belt loops 128 about which a false belt 130 is provided. Other ways of defining a false waistband, such as by providing an elastic band, or a decorative trim, may be employed without departing from the spirit of the invention. The false belt 130 may be worn either unfastened as shown, or fastened. When pants 100 are worn with a garment such as a shirt or blouse (not shown), the lower edge of the shirt or blouse serves to obscure the portion of pants 100 above the false waistband 126, thereby creating the illusion that a traditional pair of single-waistband pants are being worn at a level below the waist.

Referring to FIG. 1, the false waistband is defined by a series of false waist belt loops 128, including a pair of front belt loops 150 formed from the material defining prominent front pockets 152. This construction heightens the illusion that the false waistband is the true waistband. In an alternate embodiment such as that shown in FIG. 4, the false belt loops 128 may be constructed in a more traditional manner in which all belt loops are formed from a small piece of material attached to the pants.

To further this illusion, pockets such as front pocket 132 and rear pocket 134 are provided at a position in the pants 100 which would appear to be their normal positions relative to the false waistband 126. In addition, the crotch 116 is formed such that it is deeper than that of an ordinary pair of pants. Accordingly, the pants of the present invention will truly appear to sag in the crotch area because the crotch is constructed to extend toward the knees just as would be the case with a conventional pair of pants worn in a sagging style. Thus, the name, 'drop crotch.'

In the traditional manner of achieving the saggy pants look, pants with large waistbands are worn at a level typically below the hips. Unless pants with short inseams, and therefore, legs are used, an excess of material gathers around the cuffs at the feet of the wearer. This creates the possibility that the cuffs will slip down under the shoe, snag a protrusion while walking or get caught in a bicycle chain and trip the wearer, thereby resulting in injury. Alternatively, if shorter inseams are chosen, the desired visual effect of wearing sloppy and sagging pants cannot properly be attained. Thus, to further the illusion of saggy pants, the lengths of the pant legs (i.e., left front and rear panels and right front and rear panels) are constructed such that they are much longer than a conventional pair of paints. In addition, buttons, hooks, ties, or other fasteners may be provided inside the leg portions of the left and right sections to hold the gathered material in place to prevent the material from slipping.

Figure 4:
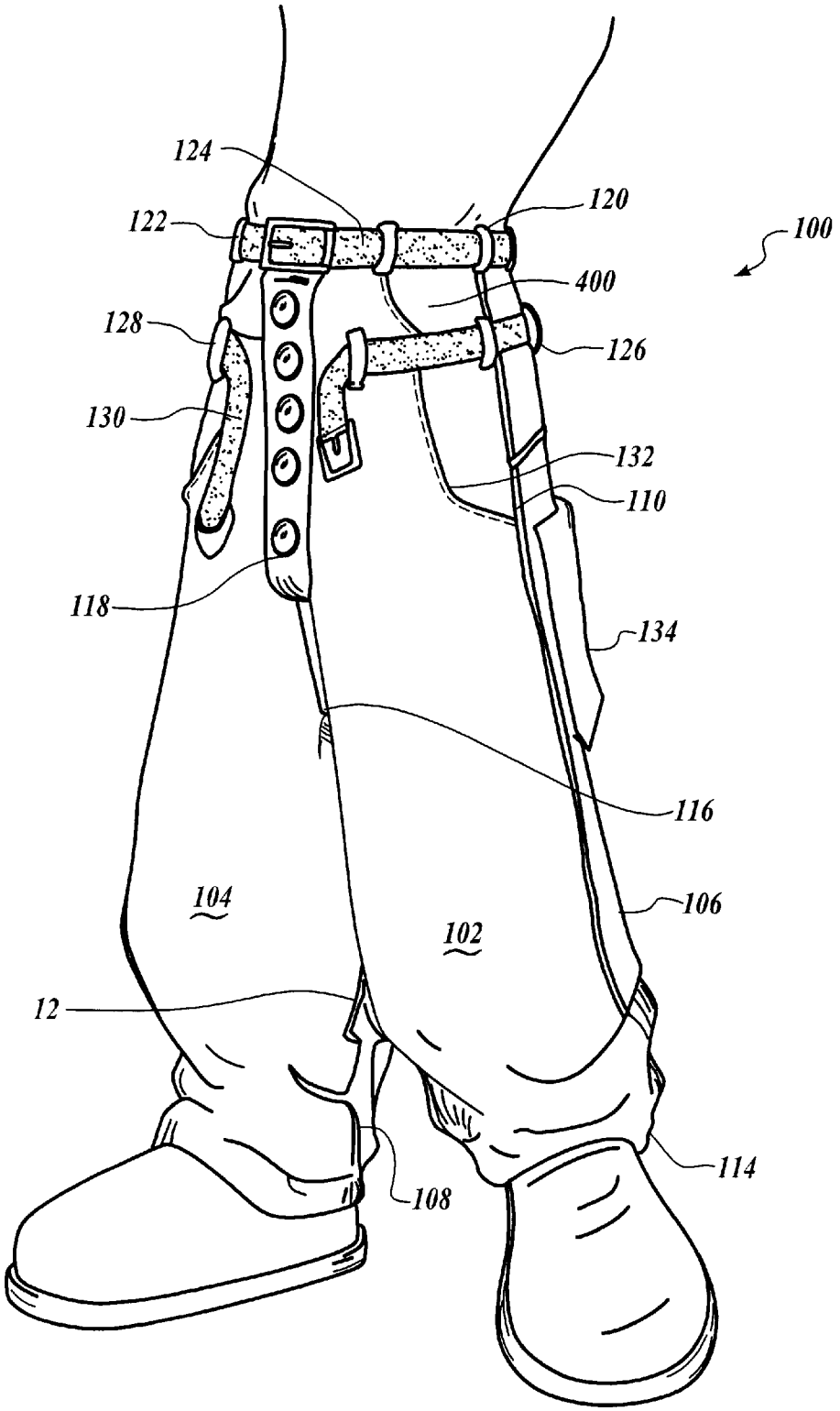
FIG. 4 is a front perspective view of pants according to an alternative embodiment of the present embodiment of the invention.

Referring to FIG. 4, in an alternative embodiment of the present invention, in which an additional front pocket 400 is provided between the true and false waistbands 120 and 126, respectively. As with the false belt and lower rear pockets, the additional front pocket 400 enhances the illusion of an actual sagging pair of pants.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A double waistband pants comprising:

a torso covering portion having a true waistband at the upper edge thereof, the true waistband for supporting the pants around a wearer's waist;

leg portions depending downwardly from the torso covering portion; and a false waistband provided on the torso covering portion at a level between the true waistband and the tops of the leg portions, wherein the false waistband extends substantially completely around the torso covering portion.

2. The pants of claim 1, further comprising at least one pocket positioned below the false waistband at a level substantially below the level of a wearer's hips.

3. The pants of claim 2, wherein the at least one pocket is positioned one to five inches below the false waistband.

4. The pants of claim 1, wherein the false waistband is defined by a plurality of false belt loops disposed circumferentially about the torso covering portion.

5. The pants of claim 4, wherein the false waistband is further defined by a false belt disposed through the plurality of false belt loops.

6. The pants of claim 1, wherein the torso portion and the leg portions define a crotch portion, the crotch portion disposed in the pants at a level substantially below the level of a wearer's crotch.

7. The pants of claim 1, wherein the leg portions are of a length sufficient to extend beyond a wearer's heel when worn.

* * * * *